US006726640B2

(12) United States Patent
Ching-Chen

(10) Patent No.: US 6,726,640 B2
(45) Date of Patent: Apr. 27, 2004

(54) MASSAGING DEVICE WITH DOUBLE MASSAGING FUNCTIONS

(76) Inventor: Chen Ching-Chen, No. 80-2, Wung-Yuann Rd., Pei-Dou Cheng, Chang-Hau Hsien (TW)

( * ) Notice: Subject to any disclaimer, the term of this patent is extended or adjusted under 35 U.S.C. 154(b) by 0 days.

(21) Appl. No.: 10/128,301

(22) Filed: Apr. 24, 2002

(65) Prior Publication Data

US 2003/0204153 A1 Oct. 30, 2003

(51) Int. Cl.[7] ..... A61H 15/00

(52) U.S. Cl. ..... 601/125; 601/112; 601/113; 601/129; 601/107; 601/118

(58) Field of Search ..... 601/112, 113, 601/118–123, 107, 125, 129, 131; D24/211, 214

(56) References Cited

U.S. PATENT DOCUMENTS

| | | | | | |
|---|---|---|---|---|---|
| 1,908,051 | A | * | 5/1933 | Reichl | 601/119 |
| RE19,696 | E | * | 9/1935 | Hemp | 601/129 |
| 2,621,652 | A | * | 12/1952 | Ehrhardt | 601/119 |
| 4,378,007 | A | * | 3/1983 | Kachadourian | 601/121 |
| 5,218,955 | A | * | 6/1993 | Gueret | 601/123 |
| D408,545 | S | * | 4/1999 | Taylor | D24/214 |
| 6,165,145 | A | * | 12/2000 | Noble | 601/111 |

* cited by examiner

*Primary Examiner*—Nicholas D. Lucchesi
*Assistant Examiner*—L Amerson
(74) *Attorney, Agent, or Firm*—Troxell Law Office PLLC

(57) ABSTRACT

Massaging device with double massaging functions, including a main body and at least one roller assembly including a roller pivotably disposed on a predetermined portion of the main body about a pivot shaft and a resilient member which is cylindrical and made of flexible material. The resilient member is fitted around the roller and has a top end and a body section. Multiple first and second protuberances are respectively formed on outer faces of the top end and body section of the resilient member. By means of rolling the roller assembly, the second protuberances in turn contact with and massage human skin to achieve a pressing type massaging effect. Alternatively, a user can hammer a part of human body with the first protuberances to achieve a hammering type massaging effect.

8 Claims, 5 Drawing Sheets

MASSAGING DEVICE WITH DOUBLE MASSAGING FUNCTIONS

BACKGROUND OF THE INVENTION

The present invention is related to a massaging device, and more particularly to a massaging device which can roll on and press or hammer a part of human body to achieve double massaging functions.

There are various conventional massaging devices. Such massaging devices can be substantially divided into electrically operable type and manually operable type. The electrically operable type massaging device has larger volume and is powered by a power supply, such as massaging chair, sole massager, massaging bar, etc. The manually operable type massaging device has small volume and is easily portable and can be used without power supply. The manually operable type massaging device can be divided into hammering type, rubbing type, roller type, etc.

FIG. 1 shows a conventional roller type massaging device including a main body as a handle and two pairs of rollers respectively pivotally disposed on front and rear sides of the main body about two pivot shafts. Multiple protuberances are formed over the outer circumferences of the rollers. In use, a user holds the main body with one hand and makes the rollers contact with a part of human body to be massaged. Then the user pushes the main body to make the rollers roll over the part. At this time, the protuberances of the rollers in turn press and massage the part.

Referring to FIG. 2, the protuberances of the rollers of the above massaging device have a conic form and lack resilience. When contacting with human skin, the protuberances often sting the skin and make a user feel uncomfortable. Moreover, the protuberances contact with the skin by small area and exert little pressing force onto the muscle. When applied to a part with thicker muscle, the massaging device can hardly provide effective massaging effect to relieve the user from dull pain. Also, a user cannot use the roller type massaging device to hammer and massage human body.

SUMMARY OF THE INVENTION

It is therefore a primary object of the present invention to provide a massaging device which can roll on and press or hammer a part of human body to achieve double massaging functions. A user can selectively use the massaging device in different manners as necessary.

It is a further object of the present invention to provide the above massaging device which has very good resilience and makes a user feel more comfortable when massaged. Therefore, the user can apply the massaging device to a relatively sensitive part of human body without being hurt.

According to the above objects, the massaging device with double massaging functions of the present invention includes a main body and at least one roller assembly including a roller pivotably disposed on a predetermined portion of the main body about a pivot shaft and a resilient member which is cylindrical and made of flexible material. The resilient member is fitted around the roller and has a top end and a body section. Multiple first and second protuberances are respectively formed on outer faces of the top end and body section of the resilient member. By means of rolling the roller assembly, the second protuberances in turn contact with and massage human skin to achieve a pressing type massaging effect. Alternatively, a user can hammer a part of human body with the first protuberances to achieve a hammering type massaging effect.

The present invention can be best understood through the following description and accompanying drawings wherein:

DETAILED DESCRIPTION OF THE PREFERRED EMBODIMENTS

Figure 3:
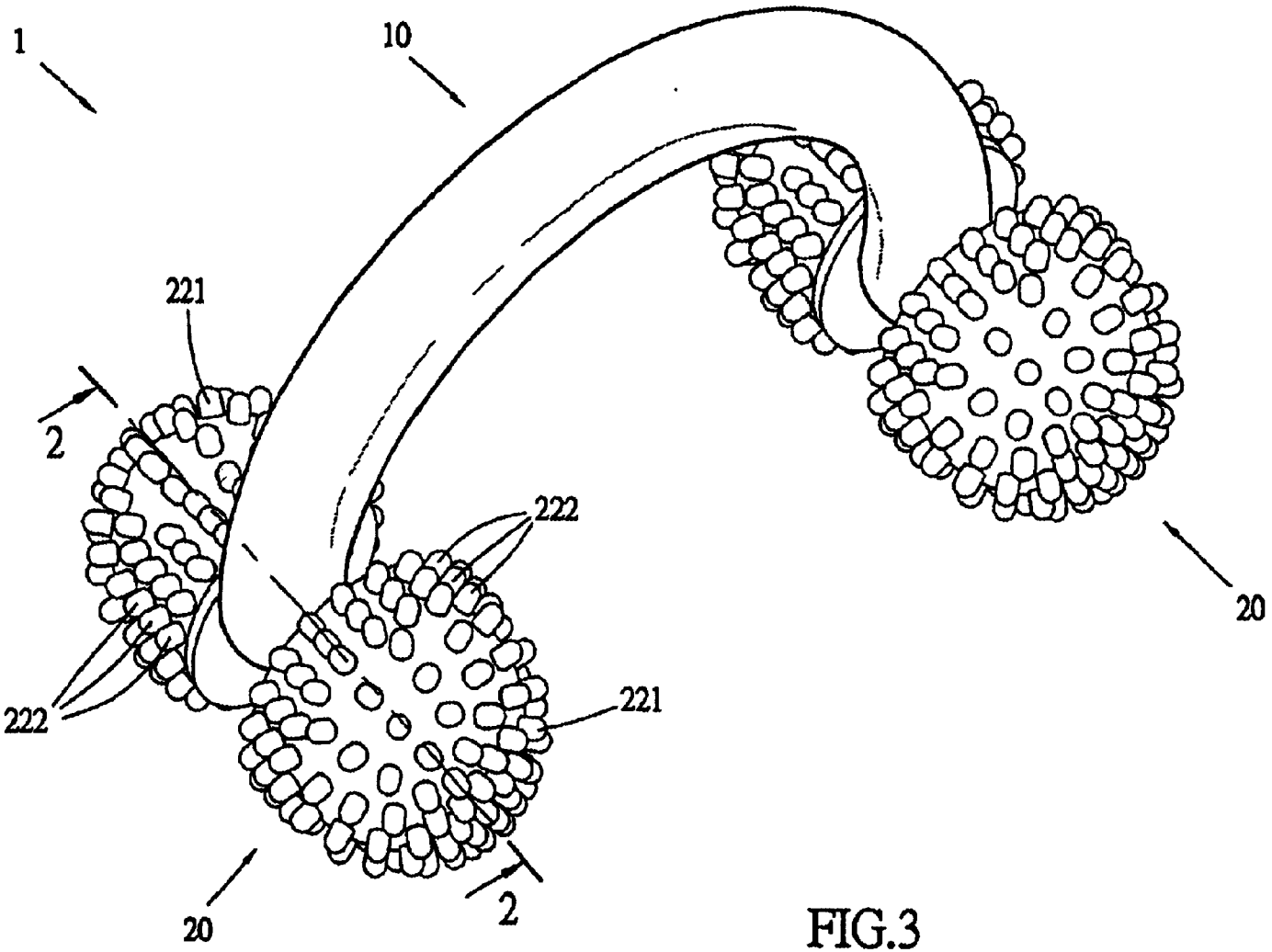
FIG. 3 is a perspective view of a preferred embodiment of the present invention.
Figure 4:
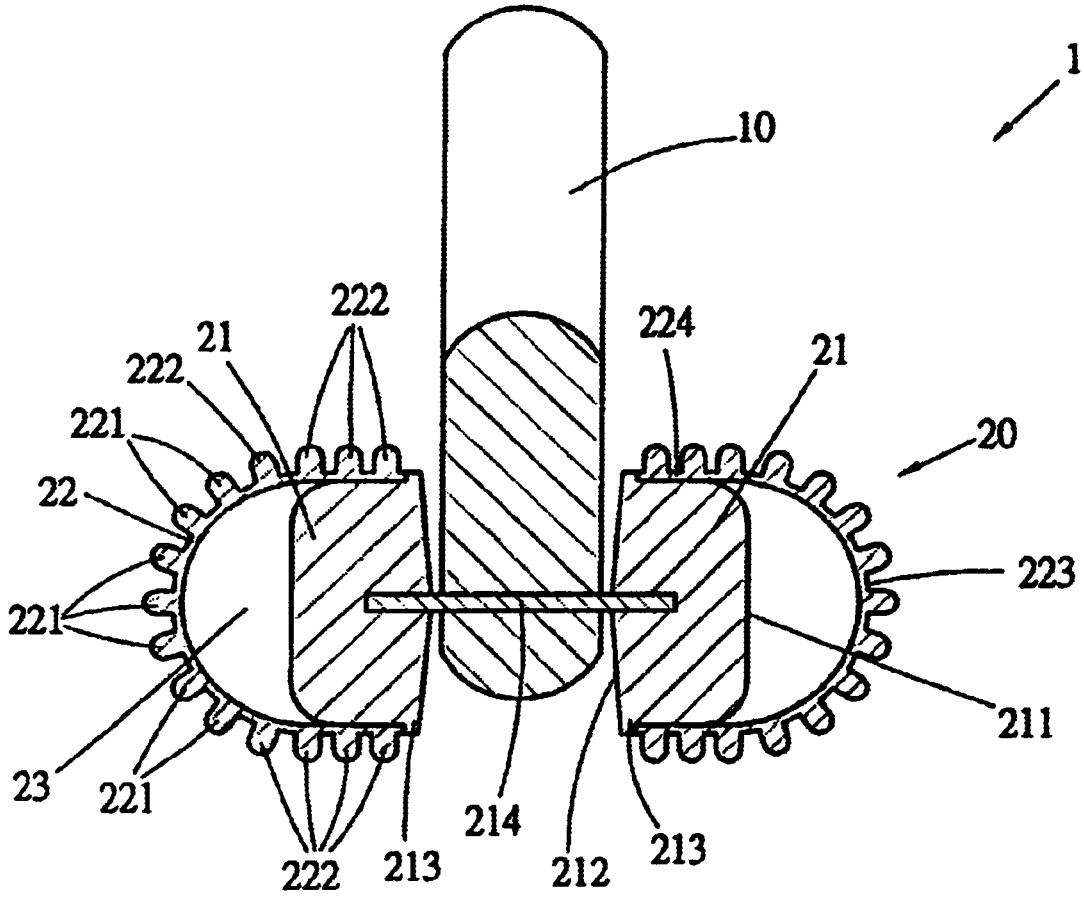
FIG. 4 is a plane sectional view of the embodiment of FIG. 3.

Please refer to FIGS. 3 and 4. The massaging device 1 with double massaging functions of the present invention includes a main body 10 and two roller assemblies 20 pivotally disposed on front and rear ends of the main body 10.

The main body 10 is formed with a certain shape and serves as a handle for a user to hold.

Each roller assembly 20 includes a pair of rollers 21 freely pivotable on a pivot shaft 214. The roller 21 is cylindrical, having a top section 211 and a bottom section 212. A flange 213 is formed on outer circumference of the roller 21 and adjacent to the bottom section 212. A resilient member 22 is fitted around each roller 21. The resilient member 22 is made of flexible material, having a hollow dome-shaped top end 223 and a hollow cylindrical body section 224. The inner face of the top end 223 is spaced from the top section 211 of the roller 21 to define a first space 23. Multiple first protuberances 221 are integrally formed on outer face of the top end 223. Each first protuberance 221 is a post having a dome-shaped free end. The first protuberances 221 are radially arranged with their axes passing through the circular center of the dome-shaped top end 223. The extending directions of the respective first protuberances 221 and the axis of the pivot shaft 214 contain angles within a range from 0 to 45. Multiple second protuberances 222 are integrally formed on outer face of the body section 224. The axes the second protuberances 222 and the axis of the pivot shaft 214 contain angles within a range from 75 to 90

The resilient member 22 is fitted around the roller 21 with the inner face of the body section 224 tightly attaching to outer face of the roller 21. The open end of the resilient member 22 tightly abuts against the flange 213 to prevent the roller 21 from being over-plugged into the resilient member 22. The two roller assemblies 20 are pair by pair symmetrically pivotally mounted on left and right sides of front and rear ends of the main body 10.

According to a first using manner of the present invention, a user can hold the main body 10 with one hand and place the body sections 224 of the roller assemblies 20 on a part of human body to be massaged. At this time, the second protuberances 222 directly contact with the skin 40. Then the user pushes the main body 10 to drive the roller assemblies 20 to roll and displace. Accordingly, the second protuberances 222 are rotated along with the roller assemblies 20 to in turn contact with and massage the skin 40. According to a second using manner of the present invention, a user can use the dome-shaped top end 223 of the resilient member 22 of one of the roller assemblies 20 to hammer a part of human body. Under such circumstance, the first protuberances 221 will hammer the skin 40 with greater pressure so as to achieve a massaging effect.

Figure 1:
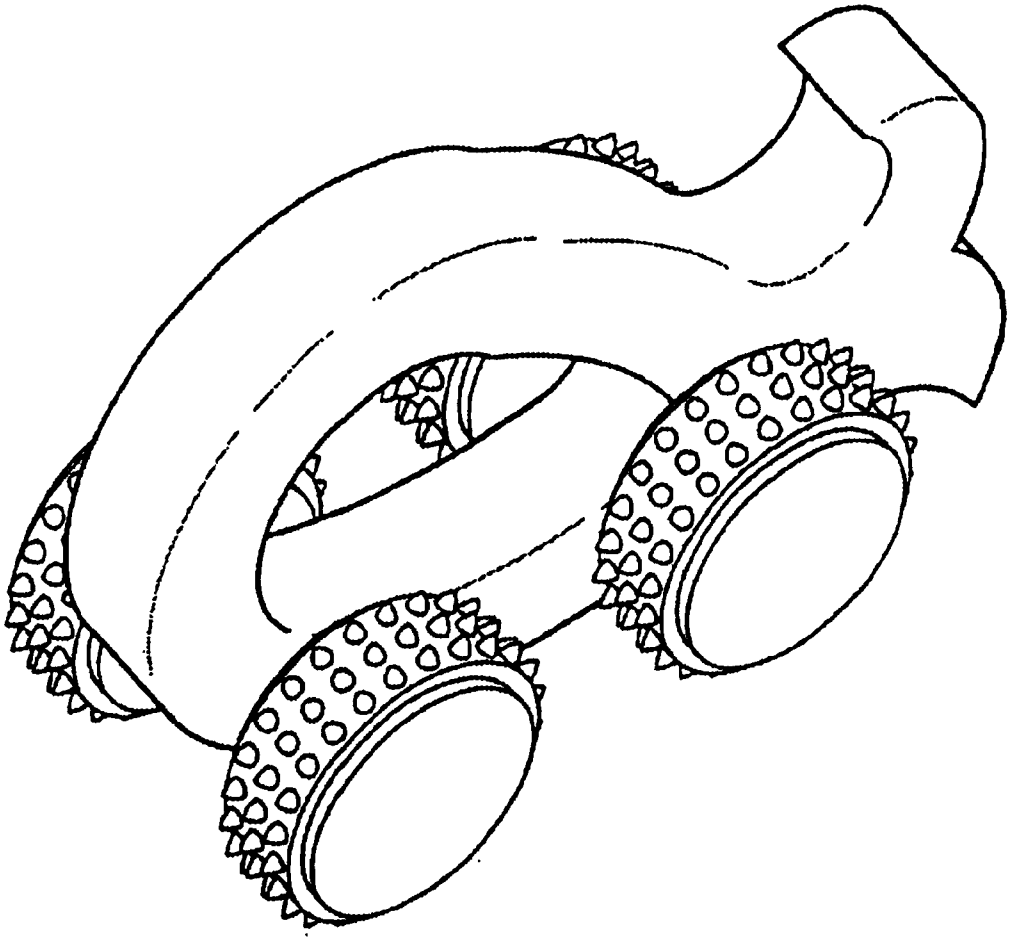
FIG.1 PRIOR ART
FIG. 1 is a perspective view of a conventional massaging device.
Figure 2:
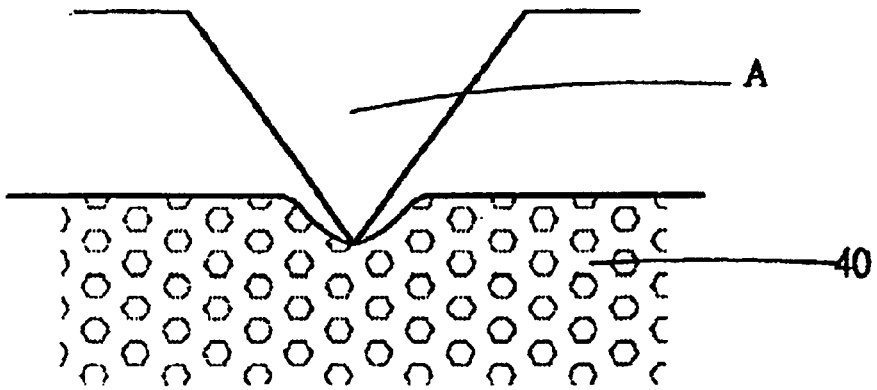
FIG.2 PRIOR ART
FIG. 2 shows that the conic protuberance of the conventional massaging device is pressed against the skin.
Figure 5:
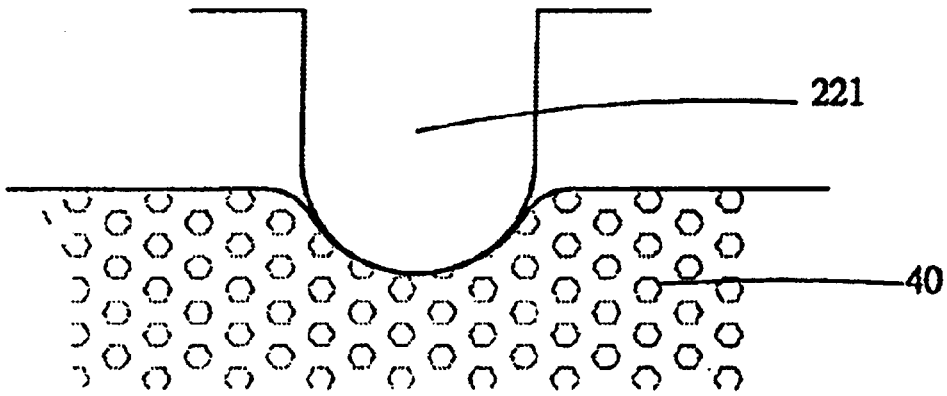
FIG. 5 shows that the dome-shaped protuberance of the massaging device of the present invention is pressed against the skin.

Referring to FIGS. 2 and 5, when the tips of the conic protuberances of the conventional massaging device press the human skin 40, the tips of the sharp protuberance A contacts with the skin 40 by small area so that the sharp protuberance A will sting the skin. On the contrary, the free ends of the first and second protuberances 221, 222 of the present invention are dome-shaped so that they contact with the skin by larger area. Accordingly, the user will feel more comfortable when using the massaging device.

Furthermore, when hammering a part of human body with the top end 223 of the resilient member 22, by means of the resilient member's own resilience and the design of the first space 23, the first space 23 is compressed to buff the hammering force. Therefore, the skin is prevented from being directly hammered by the hard rollers 21 so as to avoid bruise.

Figure 6:
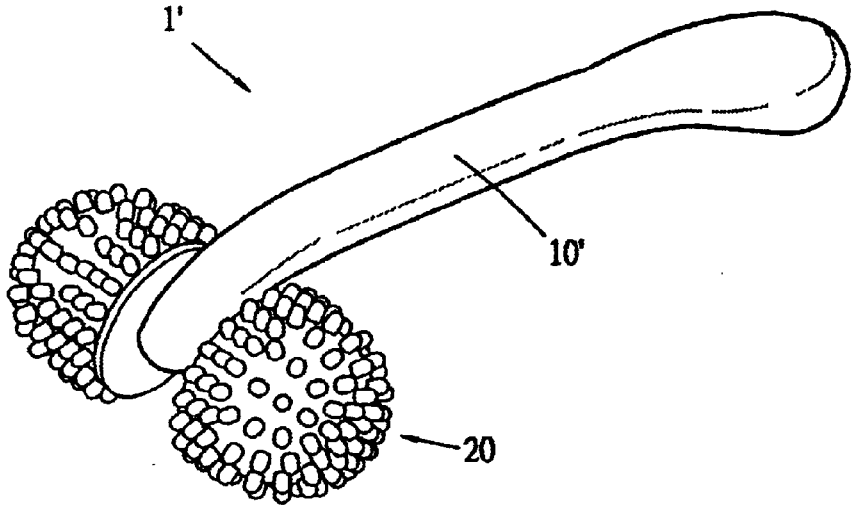
FIG. 6 is a perspective view of another embodiment of the present invention.
Figure 7:
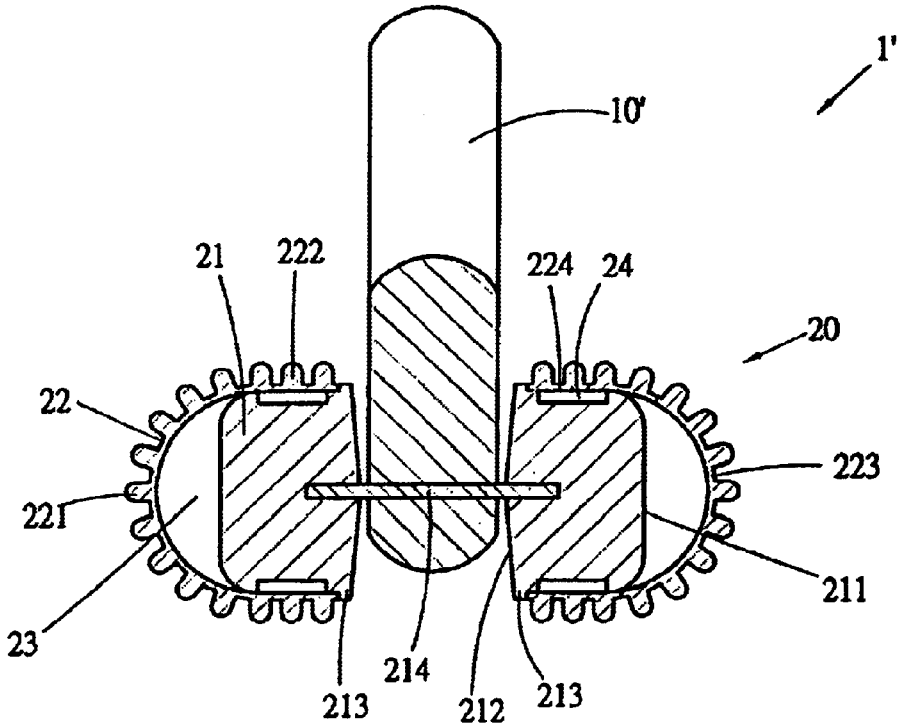
FIG. 7 is a plane sectional view of the embodiment of FIG. 6.

FIGS. 6 and 7 show another embodiment of the present invention, in which the massaging device 1' has an elongated main body 10' as a stem. Only one roller assembly 20 is pivotally mounted on one end of the main body 10'. The outer circumference of the roller 21 is formed with an annular groove. The body section 224 of the resilient member 22 and the annular groove define therebetween a second space 24. When the body section 224 is pressed against the skin 40, the second space 24 is compressed to provide a resilient force and make the user feel more comfortable when the rollers roll on the skin.

According to the above arrangement, the present invention has the following advantages:

1. The present invention has double functions of pressing type and hammering type massage. A user can selectively use the massaging device in different massaging manners with different strengths as necessary.
2. By means of the design of the dome-shaped free ends of the first and second protuberances 221, 222, the first and second protuberances 221, 222 contact with the skin by larger area and make a user feel more comfortable. Therefore, the massaging device can be used to massage a relatively sensitive part of human body.
3. By means of the first and second spaces 23, 24 defined between the resilient member 22 and the roller 21, when rolling on the skin or hammering the skin, the resilient member 22 can be resiliently contracted to buff the rolling or hammering force.

The above embodiments are only used to illustrate the present invention, not intended to limit the scope thereof. Many modifications of the above embodiments can be made without departing from the spirit of the present invention.

What is claimed is:

1. A massaging device with double massaging functions comprising:

a) a main body; and b) at least one roller assembly having:

i) a roller pivotally connected to a pivot shaft of the main body, the roller having top and bottom sections with a flange extending outwardly from an outer surface of the roller adjacent to the bottom section; and ii) a resilient member having a hollow cylindrical body and a hollow dome-shaped top, the resilient member inserted over the outer surface of the roller such that the dome-shaped top is spaced from the top section of the roller to define a space therebetween, and a plurality of first and second spaced apart protuberances extending outwardly from an outer surface of the hollow dome-shaped top, each of the plurality of protuberances having a cylindrical body and a dome-shaped free end, wherein the first protuberances extend from the outer surface of the hollow dome-shaped top at an angle between zero and forty-five degrees relative to an axis of the pivot shaft of the main body, and the second protuberances extend outwardly from the outer periphery of the hollow cylindrical body at an angle between seventy-five and ninety degrees relative to the axis of the pivot shaft.

2. The massaging device according to claim 1, wherein the main body includes a handle.

3. The massaging device according to claim 1, wherein a bottom of the resilient member is positioned adjacent to the flange of the roller.

4. The massaging device according to claim 1, wherein the roller has an annular groove on the outer periphery thereof.

5. The massaging device according to claim 1, wherein the at least one roller assembly includes two roller assemblies positioned on opposing sides of the main body.

6. The massaging device according to claim 1, wherein the at least one roller assembly includes two pairs of roller assemblies, each of the two pairs of roller assemblies having first and second roller assemblies positioned on opposing sides of the main body, the two pairs of roller assemblies located on opposing ends of the main body.

7. The massaging device according to claim 1, wherein axes of the first protuberances extend radially from a center of the hollow dome-shaped top.

8. The massaging device according to claim 1, wherein axes of the second protuberances extend perpendicular to an axis of the hollow cylindrical body.

* * * * *